US007267483B2

(12) United States Patent
Nokura

(10) Patent No.: US 7,267,483 B2
(45) **Date of Patent: *Sep. 11, 2007**

(54) CONTAINER BAG FOR SEASONING SAUCE

(75) Inventor: Takeaki Nokura, Nagoya (JP)

(73) Assignee: Daiwa Gravure Co., Ltd., Nagoya-Shi, Aichi (JP)

( * ) Notice: Subject to any disclaimer, the term of this patent is extended or adjusted under 35 U.S.C. 154(b) by 65 days.

This patent is subject to a terminal disclaimer.

(21) Appl. No.: 11/135,800

(22) Filed: May 24, 2005

(65) Prior Publication Data

US 2005/0232518 A1 Oct. 20, 2005

Related U.S. Application Data

(62) Division of application No. 10/366,485, filed on Feb. 12, 2003, now Pat. No. 6,929,399.

(30) Foreign Application Priority Data

Feb. 13, 2002 (JP) ..... 2002-034740

(51) Int. Cl.
*B65D 30/22* (2006.01)
*B65D 30/00* (2006.01)
*B65D 33/00* (2006.01)

(52) U.S. Cl. ..... 383/38; 383/37; 383/200

(58) Field of Classification Search ..... 383/37–38, 383/200–201

See application file for complete search history.

(56) References Cited

U.S. PATENT DOCUMENTS

| | | | |
|---|---|---|---|
| 3,224,640 | A | 12/1965 | Schneider et al. |
| 4,548,322 | A | 10/1985 | Cullen et al. |
| 5,512,237 | A | 4/1996 | Stigenberg |
| 5,881,869 | A | 3/1999 | Hudson |
| 6,102,571 | A | 8/2000 | Moteki et al. |
| 6,360,916 | B1 | 3/2002 | Sokolsky et al. |
| 6,789,945 | B2 | 9/2004 | Mobs et al. |

FOREIGN PATENT DOCUMENTS

DE 7931081 U 4/1980

(Continued)

OTHER PUBLICATIONS

Partial European Search Report dated May 22, 2003.

(Continued)

*Primary Examiner*—Jes F. Pascua
(74) *Attorney, Agent, or Firm*—D. Peter Hochberg; Sean Mellino

(57) ABSTRACT

A plurality of container bags containing matters such as plural kinds of seasoning sauce or two kinds of liquids of a two-liquid mixture adhesive are allowed to be cut simultaneously so that the contained matters can be taken out simultaneously. The container bags according to the present invention is such that two continuous container bags for individually containing two kinds of sauce are made of sheets comprising synthetic resin films and are joined together. Further, a fold line for folding up the two container bags is formed in the joint portion, and a notch used to form a contained-matter take-out opening formed at a position on the fold line.

8 Claims, 15 Drawing Sheets

FOREIGN PATENT DOCUMENTS

| | | | |
|---|---|---|---|
| EP | 0307194 | | 3/1989 |
| EP | 0490822 | A | 6/1992 |
| EP | 0858956 | A1 | 8/1998 |
| FR | 2801287 | A | 5/2001 |
| JP | 03133773 | | 6/1991 |
| JP | 04072162 | | 3/1992 |
| JP | 11079240 | A | 3/1999 |
| WO | WO 02/092459 | A2 | 11/2002 |

OTHER PUBLICATIONS

Complete European Search Report dated Aug. 8, 2003.

CONTAINER BAG FOR SEASONING SAUCE

CROSS REFERENCE TO RELATED APPLICATION

This application is a divisional of U.S. patent application Ser. No. 10/366,485 filed Feb. 12, 2003 now U.S. Pat. No. 6,929,399.

FIELD OF THE INVENTION

The present invention relates to a container bag which individually contains plural kinds of seasoning sauces such as dipping sauce for chaotzu (Chinese dumpling) made by mixing plural kinds of seasoning sauces, and mustard and ketchup for hot dogs, and allows one or more kinds of seasoning sauces to be taken out according to a user's liking.

BACKGROUND OF THE INVENTION

Conventionally, Chinese dumpling typically known as a convenience food, for example, is packaged in a bag together with small bags individually containing plural kinds of seasoning sauce such as Chinese spicy oil and special dipping sauce. When eating such Chinese dumpling, a plurality of small bags shaped like those disclosed in Japanese Kokai (Unexamined Patent Application) Publication No. 11-79240 are separately cut to allow the plural kinds of seasoning sauce to be taken out from the bags. In addition to such seasoning sauce, there are known two-liquid mixture adhesives which are used by mixing together two liquids contained in two separate bags. In using such adhesives, the two bags are cut separately to take out two different liquids therefrom.

However, in either case of the plural kinds of seasoning sauce or the two-liquid mixture adhesive, a plurality of bags need be cut separately to take out matters contained therein. It takes time to take out the matters from the bags, thus posing problems.

SUMMARY OF THE INVENTION

The present invention has an object to solve these problems. It is an object of the present invention to allow a plurality of container bags containing matters such as plural kinds of seasoning sauce or two liquids of a two-liquid mixture adhesive to be cut simultaneously so that the contained matters can be taken out simultaneously.

Summarized points to accomplish the object of the present invention will be described below.

It is an object of the present invention to provide container bags for containing seasoning sauce or the like wherein two container bags for individually containing two kinds of contained matters are made of sheets including synthetic resin films and joined together, a fold line used to fold up the two container bags is formed at a position on a joint portion, and a notch used to form a contained matter take-out opening is formed at the position of the fold line.

It is another object of the present invention to provide container bags for containing seasoning sauce or the like wherein a plurality of container bags for individually containing three or more kinds of matters are made of sheets including synthetic resin films and joined together to be continuous, fold lines for folding up the plurality of container bags are formed in joint portions respectively between the container bags, and a notch used to form a contained-matter take-out opening is formed at a position on each fold line.

It is yet another object of the present invention to provide the container bags wherein the notch is formed at a position close to an end of the fold line and at a longitudinal side of a matter-containing section of each container bag.

It is still yet another object of the present invention to provide the container bags, wherein the notch is formed at a plurality of positions equidistantly in a longitudinal direction of the fold line.

It is another object of the present invention to provide container bags for containing seasoning sauce or the like wherein two container bags for individually containing two kinds of contained matters are made of sheets including synthetic resin films and are joined together, a fold line used to fold up the two container bags is formed in a joint portion between the two bags, and innumerable fine pores for forming a contained-matter take-out opening are formed along and around the fold line in the joint portion.

It is another object of the present invention to provide container bags for containing seasoning sauce or the like wherein three or more container bags for individually containing three or more kinds of contained matters are made of sheets including synthetic resin films, fold lines used to fold up the plurality of container bags are formed in joint portions respectively between the container bags, and innumerable fine pores used to form a contained-matter take-out opening are formed in each joint portion along and around the fold lines.

It is still another object of the present invention to provide the container bag wherein the innumerable fine pores are formed to lie close to an end of each fold line and at a longitudinal side of a matter-containing section of each container bag.

It is still yet another object of the present invention to provide the container bags wherein the innumerable fine pores are formed over a substantially entire length of the fold line.

It is yet another object of the present invention to provide container bags for containing seasoning sauce or the like wherein two container bags individually containing two kinds of matters are joined together are made of sheets including synthetic resin films, a fold line used to fold up the two container bags is formed at a position on the joint portion, and a coating layer including a mixture of ceramic and metal particles is formed on an outer surface of the bag at a position close to the fold line thereby forming a contained-matter take-out opening.

It is another object of the present invention to provide container bags for containing seasoning sauce or the like wherein three or more container bags for individually containing three or more kinds of matters are made of sheets including synthetic resin films and joined together, fold lines used to fold up the plurality of container bags are formed in joint portions respectively between the container bags, and a coating layer including a mixture of ceramic and metal particles is formed on an outer surface of each bag at a position close to the fold line thereby forming a contained-matter take-out opening.

It is yet another object of the present invention to provide the container bags wherein the coating layer including a mixture of ceramic and metal particles is formed on the outer surface of each container bag at a position close to an end of the fold line and at a longitudinal side of a matter-containing section of each bag.

It is still yet another object of the present invention to provide the container bags wherein the coating layer including a mixture of ceramic and metal particles is formed over a substantially entire length of the fold line.

It is another object of the present invention to provide the container bags as mentioned above wherein a perforated line is formed as a fold line.

According to the configurations described above a plurality of container bags for individually containing two kinds or three or more kinds of matters are joined together. Then, the plurality of container bags are folded up along the fold line in each joint portions. Then, the plurality of container bags are cut simultaneously using the notch or innumerable fine pores formed in each joint portion on or around the fold line, or using the coating layer including a mixture of ceramic and metal particles. Consequently, the separately contained different matters can be taken out simultaneously. This allows the take-out operation to be performed easily as compared with the conventional art in which a plurality of bags are separately cut to allow contained matters to be taken out.

DESCRIPTION OF THE EMBODIMENTS

Figure 1:
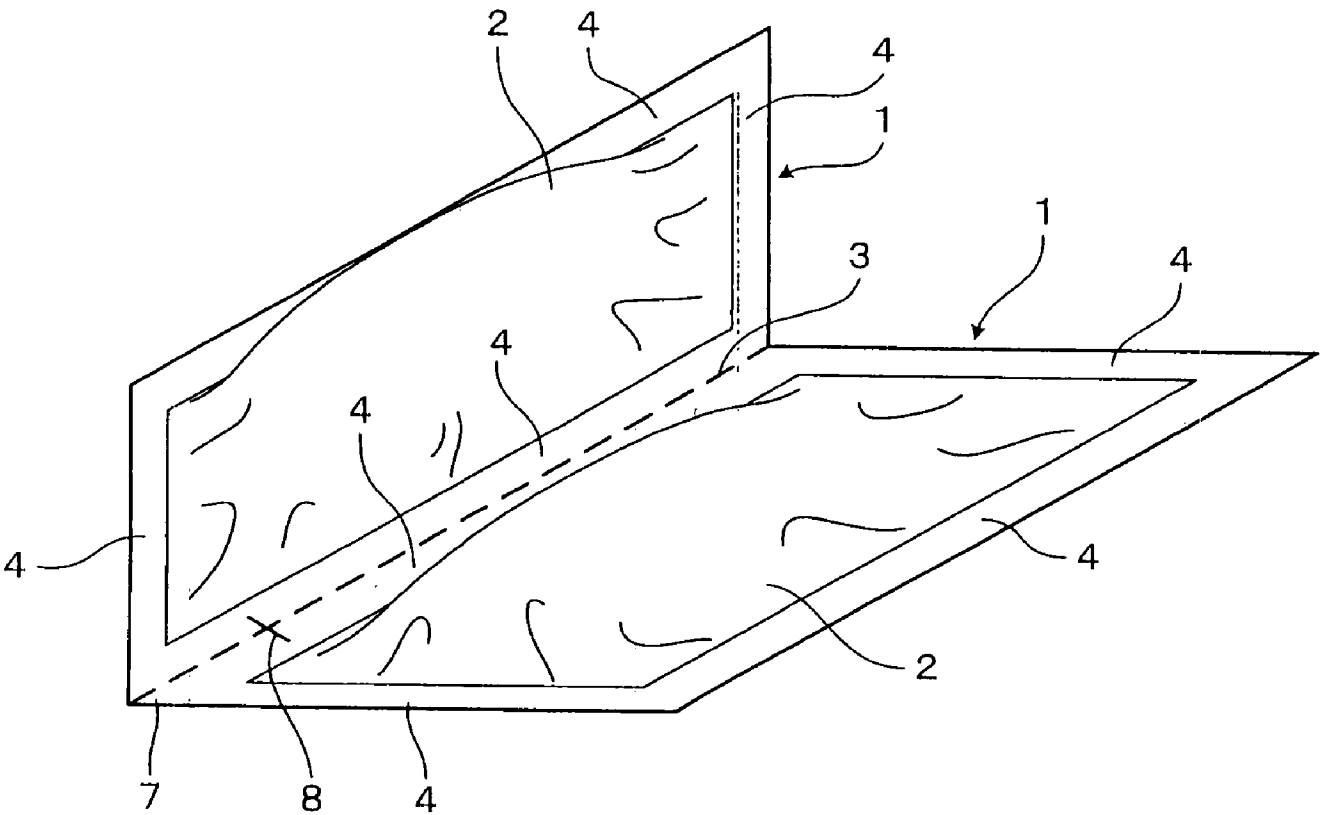
FIG. 1 is a perspective view of a container bag according to a first embodiment of the present invention.
Figure 2:
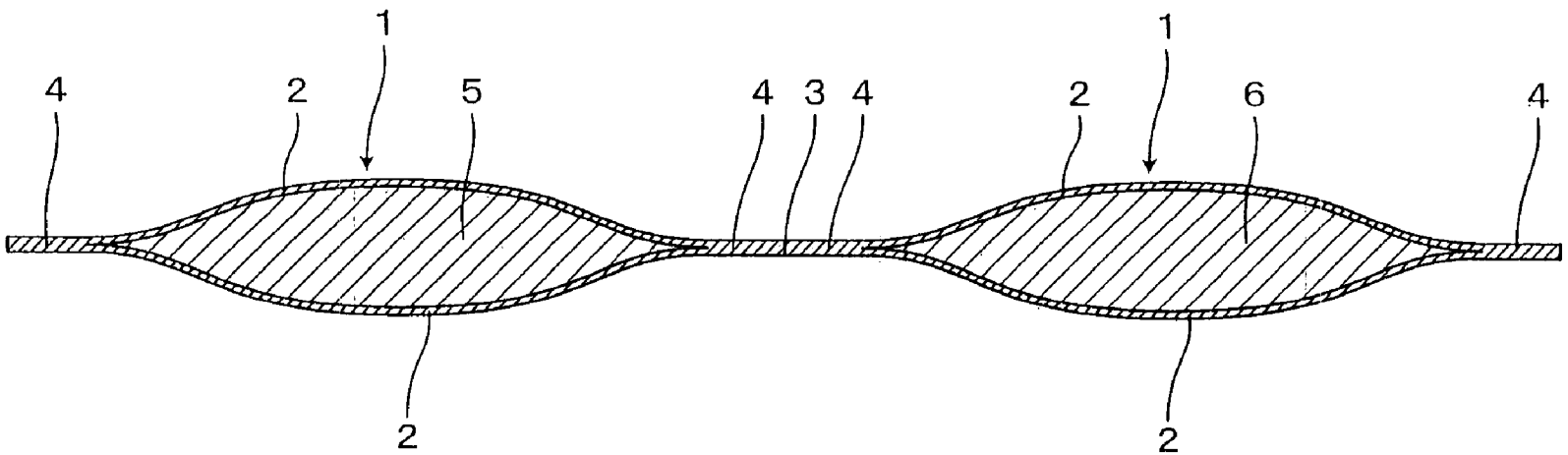
FIG. 2 is a sectional view of the container bag.

FIGS. 1 to 4 show a first embodiment of the present invention.

In FIGS. 1 to 4, reference numerals 1, 1 denote two parallelogram container bags formed by joining two sheets 2, 2 together at their corresponding long sides, the two sheets being composed of synthetic resin films. At the joint portion, formed of the long sides, a perforated line 3 is formed along these lines. More specifically, the two container bags 1, 1 are closed at their peripheries by heat seal portions 4, 4. Mustard 5 is contained inside one of the container bags 1 as a contained matter, and ketchup 6 is contained inside the other container bag 1. The mustard 5 and ketchup 6 individually contained in the two container bags 1, 1 are taken out from the container bags 1, 1 when needed to be used as seasoning sauce for a hot dog sold at a store.

The above described two parallelogram container bags 1, 1, as joined together, has such an outer shape that one end projects in V form, while the other end is split in V form. On the heat seal portions 4, 4, a notch 8 is formed close to the one-end-side V-shaped projecting portion 7 across the perforated line 3. More specifically, the notch 8 is formed close to an end of the perforated line 3, located close to the one-end-side V-shaped projecting portion 7, and at a side of each contained matter containing section.

Figure 3:
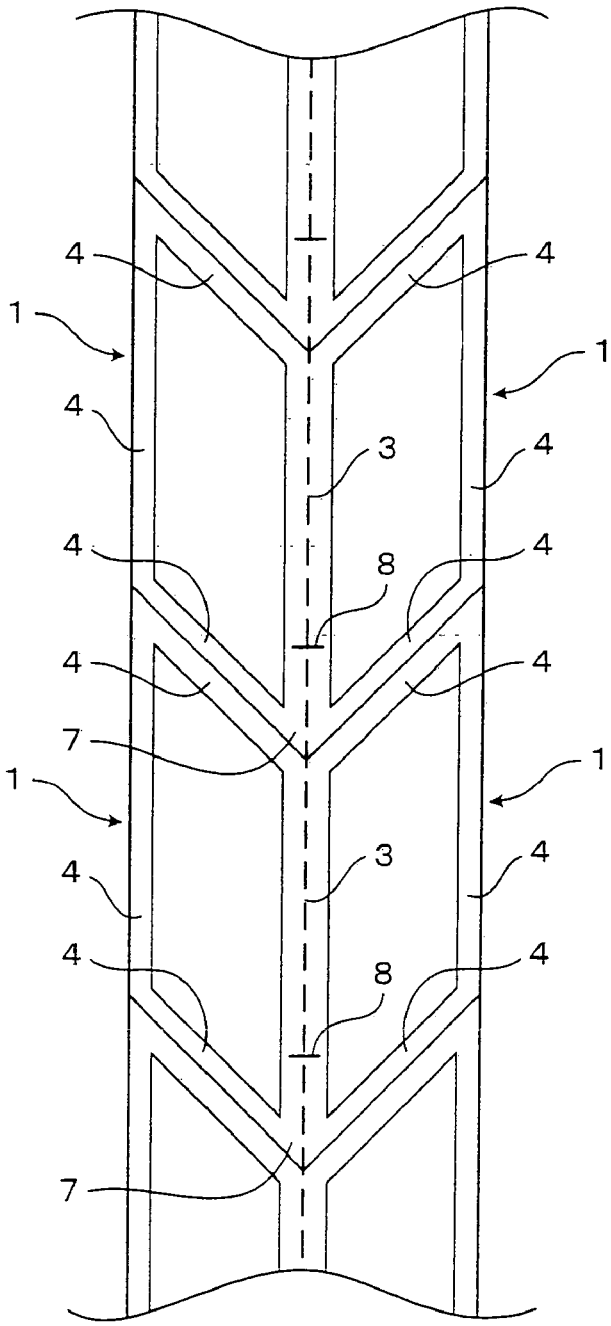
FIG. 3 is a diagram illustrating how to make a container bag.
Figure 4:
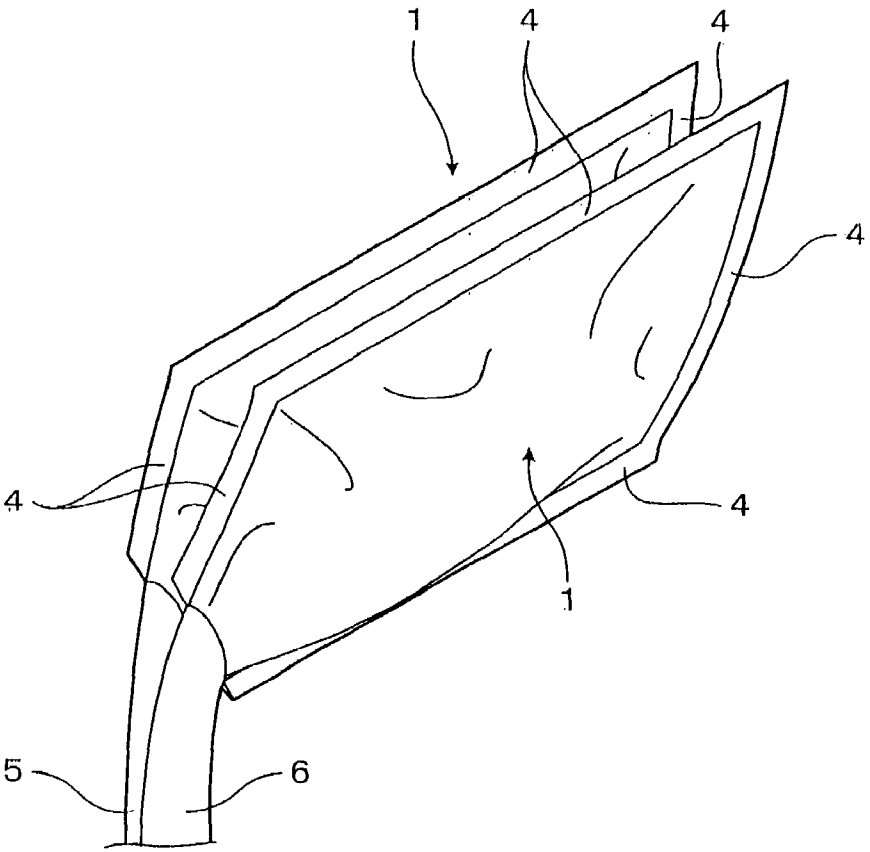
FIG. 4 is a perspective view showing how a contained matter is taken out from the container bag.

The two container bags 1, 1, joined together via the perforated line 3 as described above, are closed by closing filling ports by the heat seal portions 4, with matters filled into the respective container bags 1, 1. The perforated line 3 and the notch 8 are formed between the two adjacent container bags 1, 1 as shown in FIG. 3.

The two container bags 1, 1, joined together via the perforated line 3, contain the mustard 5 and the ketchup 6, as described previously. When the mustard 5 and the ketchup 6 are put on a hot dog before eating, the two container bags 1, 1 are folded in two using the perforated line 3 as a fold line. In this state, the two container bags 1, 1 are simultaneously cut using the notch 8 to form a contained-matter take-out opening. Then, the container bags 1, 1 are squeezed with fingertips to simultaneously take out the mustard 5 and ketchup 6.

Figure 5:
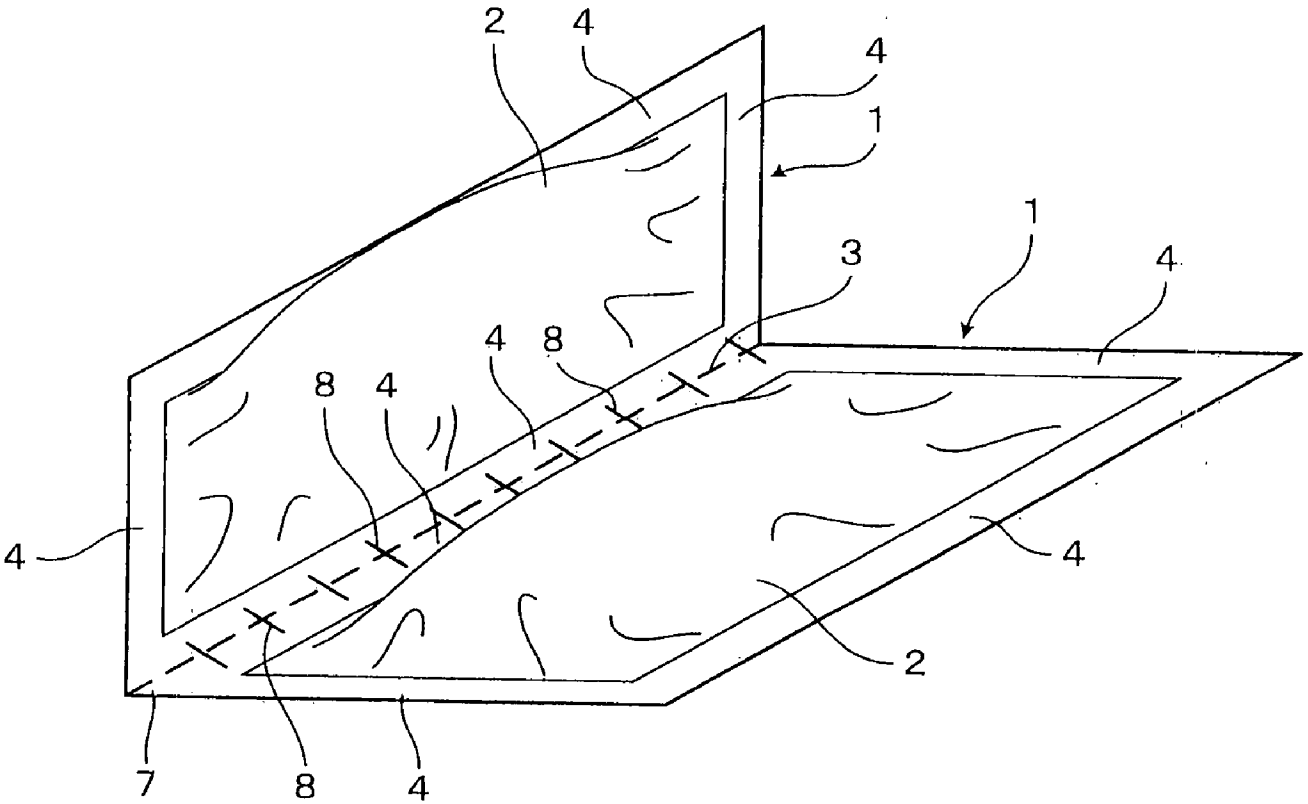
FIG. 5 is a perspective view of a container bag according to a second embodiment of the present invention.
Figure 6:
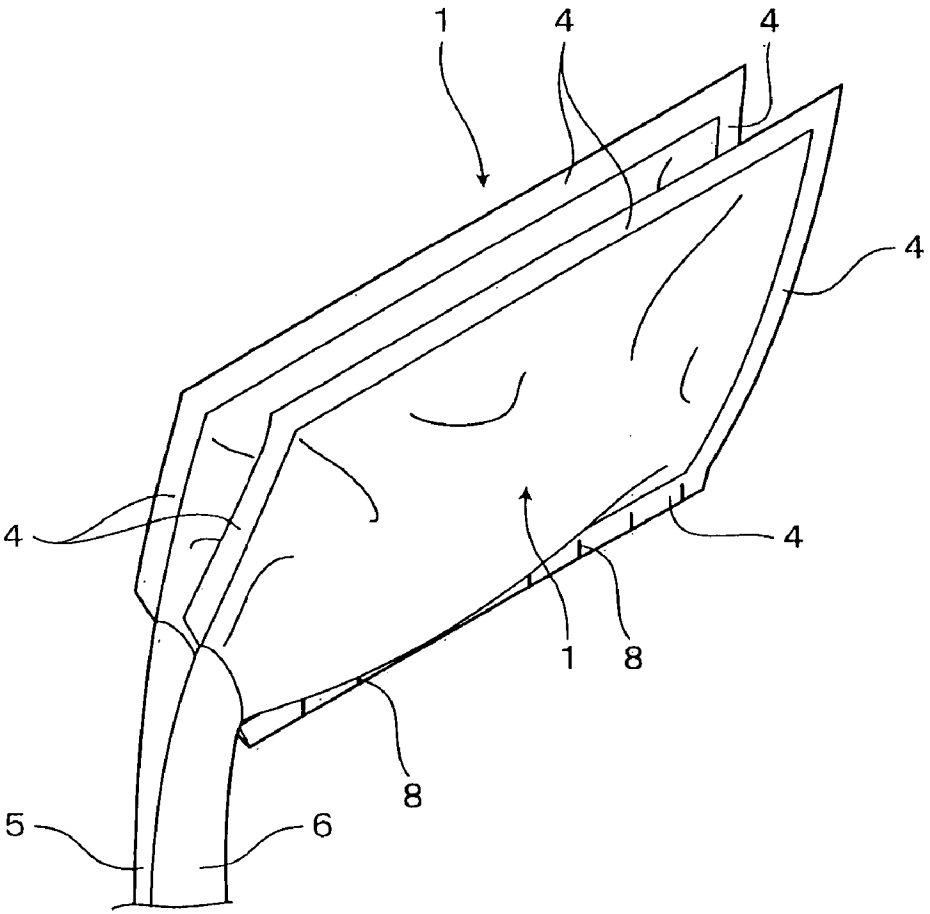
FIG. 6 is a perspective view showing how a contained matter is taken out from the container bag.

FIGS. 5 and 6 show a second embodiment of the present invention.

Description will be given with reference to FIGS. 5 and 6. In the first embodiment, the notch 8 is formed to lie close to the end of the perforated line 3, located close to the one-end-side V-shaped projecting portion 7, and at the side of each matter containing section. However, notches 8 may be formed over the entire length of the perforated line 3 at uniform intervals in a longitudinal direction of the perforated line 3 as in the second embodiment, shown in FIG. 5. By thus forming the notches 8 at the plurality of portions, any one of the notches 8, which are present at the fold line between the two container bags 1, 1 as folded in two, can be selected to simultaneously cut the container bags 1, 1, thus forming a contained-matter take-out opening. That is, one of the notches 8 which is to be cut may be selected according to the size of a contained-matter take-out opening to be formed.

Figure 7:
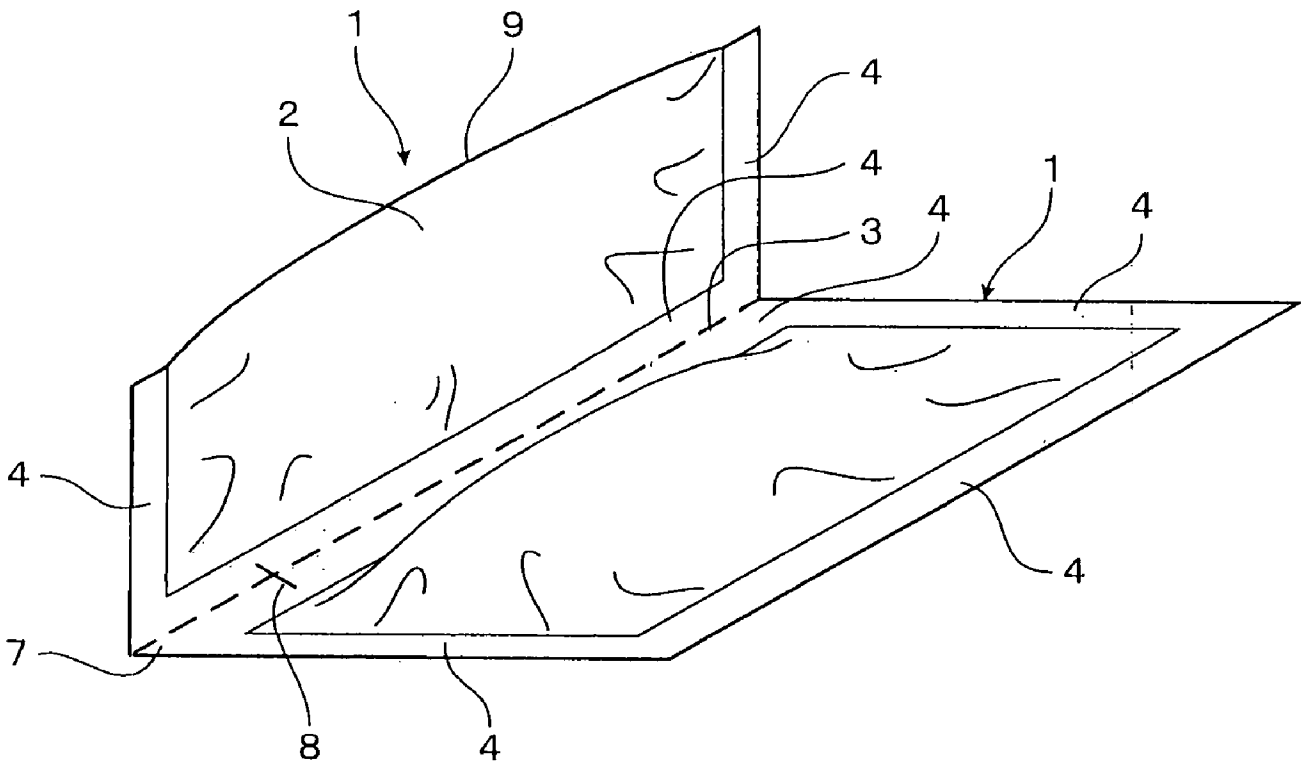
FIG. 7 is a perspective view of a container bag according to a third embodiment of the present invention.
Figure 8:
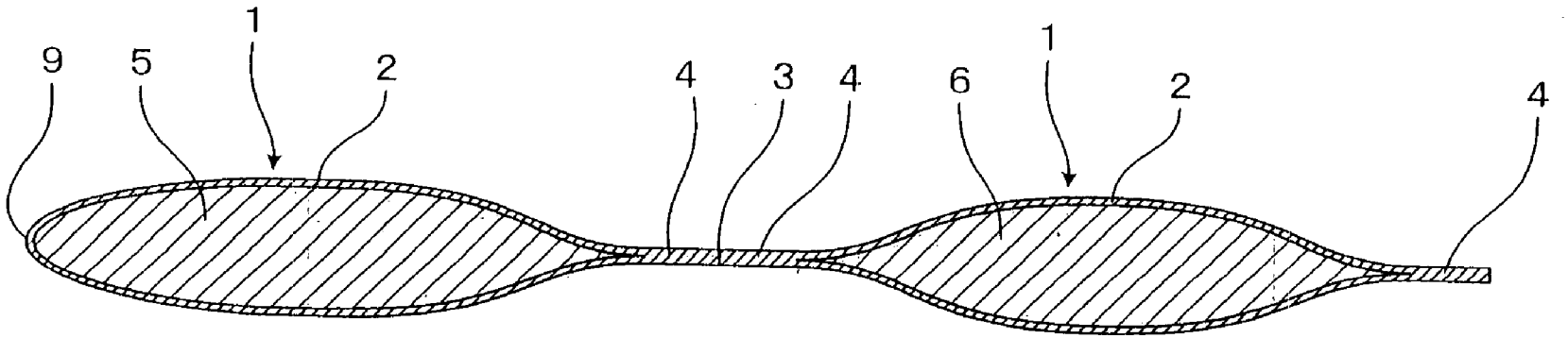
FIG. 8 is a sectional view of the container bag.
Figure 9:
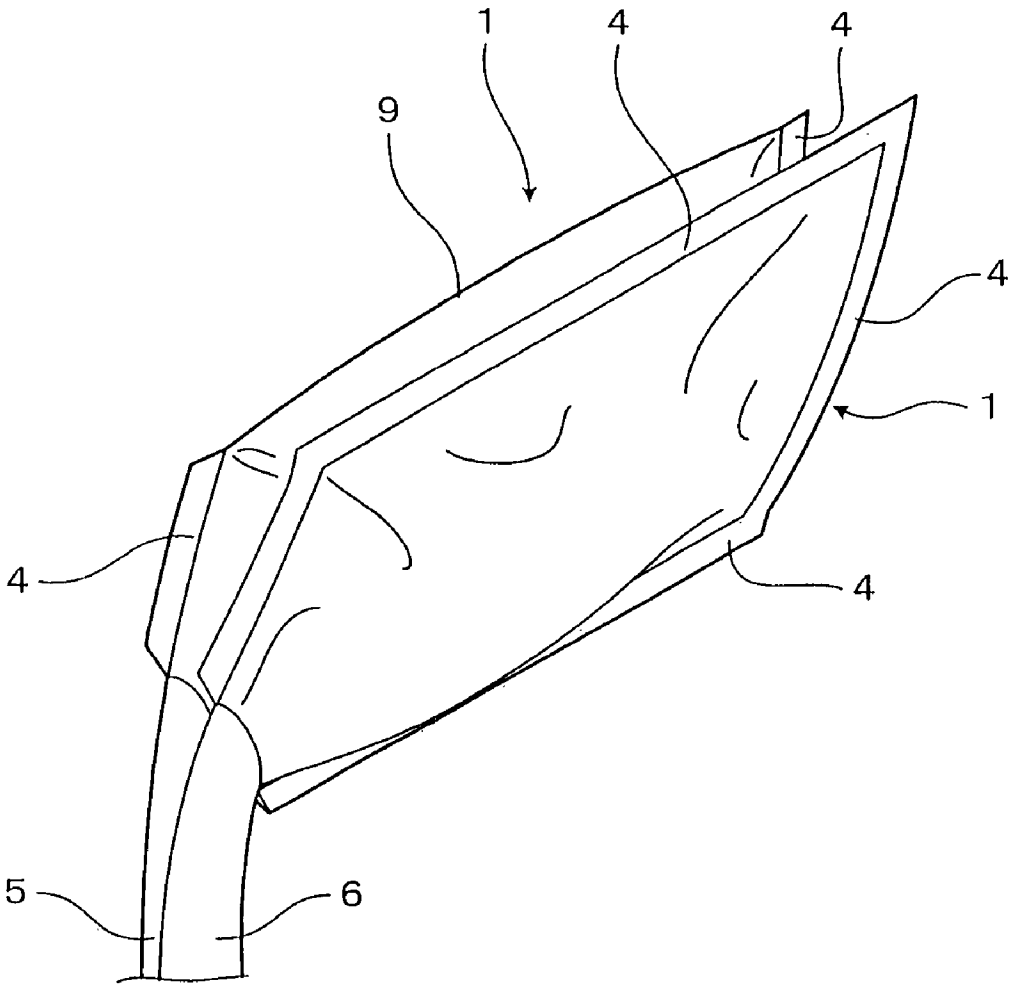
FIG. 9 is a perspective view showing how a contained matter is taken out from the container bag.

FIGS. 7 to 9 show a third embodiment of the present invention.

Description will be given with reference to FIGS. 7 to 9. In the first and second embodiments, the two sheets 2, 2, composed of synthetic resin films, are used to simultaneously create the two container bags 1, 1. However, in the third embodiment, one sheet 2 composed of a synthetic resin film is folded in two. Then, the periphery of the sheet 2 is similarly closed except for the fold line 9 by the heat seal portion 4 similarly as the above-described first embodiment to form two container bags 1, 1. According to this configuration, one of the two container bags 1, 1 has its four sides closed by the heat seal portion 4. The other container bag 1 has its three sides except the fold line 9 closed by the heat seal portion 4. The other arrangements of this embodiment are the same as those of the first embodiment. Thus, their detailed description is omitted.

As an applied example of the third embodiment, notches 8 may be formed over the entire length of the perforated line 3 at uniform intervals in the longitudinal direction of the perforated line 3 as in the second embodiment.

Figure 10:
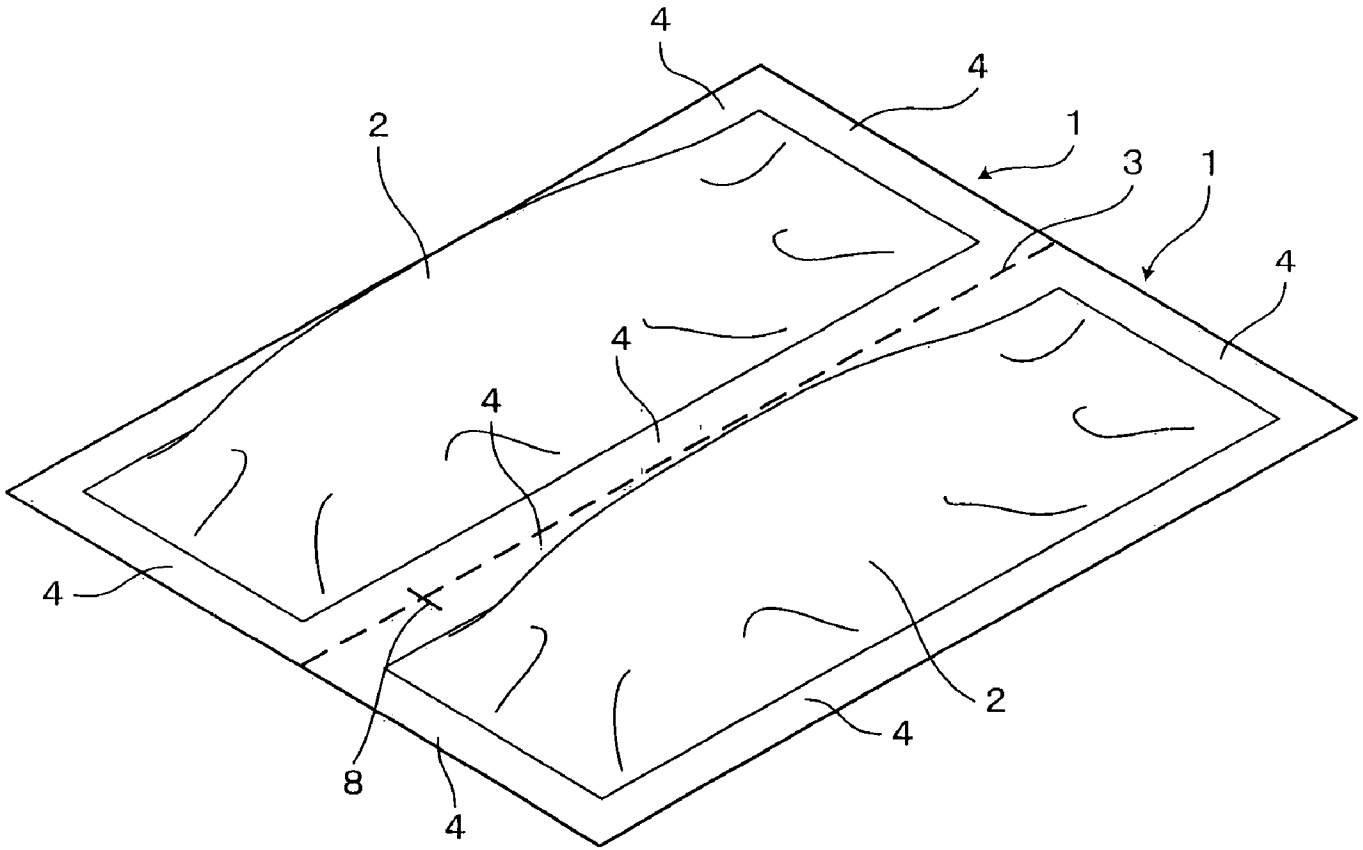
FIG. 10 is a perspective view of a container bag according to a fourth embodiment of the present invention.
Figure 11:
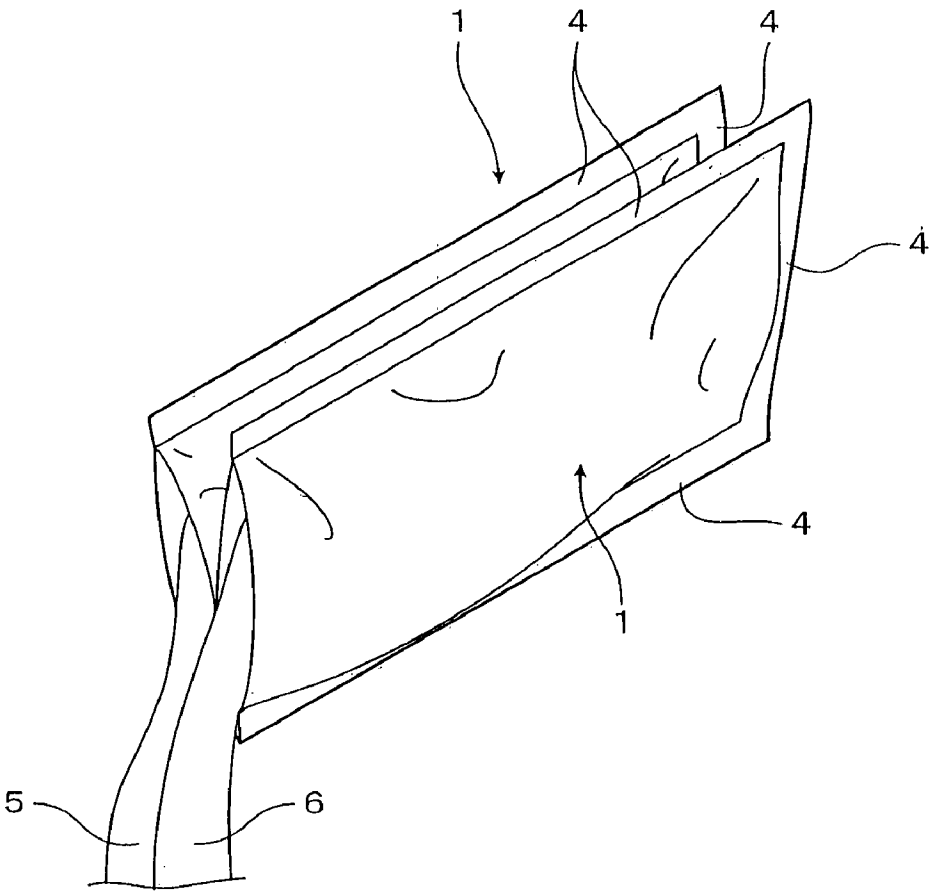
FIG. 11 is a perspective view showing how a contained matter is taken out from the container bag.

FIGS. 10 and 11 show a fourth embodiment of the present invention.

Description will be given with reference to FIGS. 10 and 11. In the first embodiment, the two parallelogram container bags 1, 1 are joined together so as to have such an outer shape that one end of the bags projects in V form, while the other end is split in V form. In a fourth embodiment, corresponding long sides of the bags are joined together to form two rectangular container bags 1, 1. That is, in the first embodiment, the container bags 1 are parallelograms. However, in the fourth embodiment, the container bag 1 is rectangular so that a larger contained-matter take-out opening can be formed by folding the two container bags 1, 1 in two using the perforated line 3 as a fold line and simultaneously cutting the two container bags 1, 1 using the notch 8. The other arrangements of this embodiment are the same as those of the first embodiment. Their detailed description is thus omitted.

In addition, as a variation of the fourth embodiment, one sheet 2 composed of a synthetic resin film can be folded in two to form two container bags 1, 1 the corresponding long sides of which are joined together. Alternatively, notches 8 may be formed over the entire length of the perforated line 3 at uniform intervals in the longitudinal direction of the perforated line 3.

Figure 12:
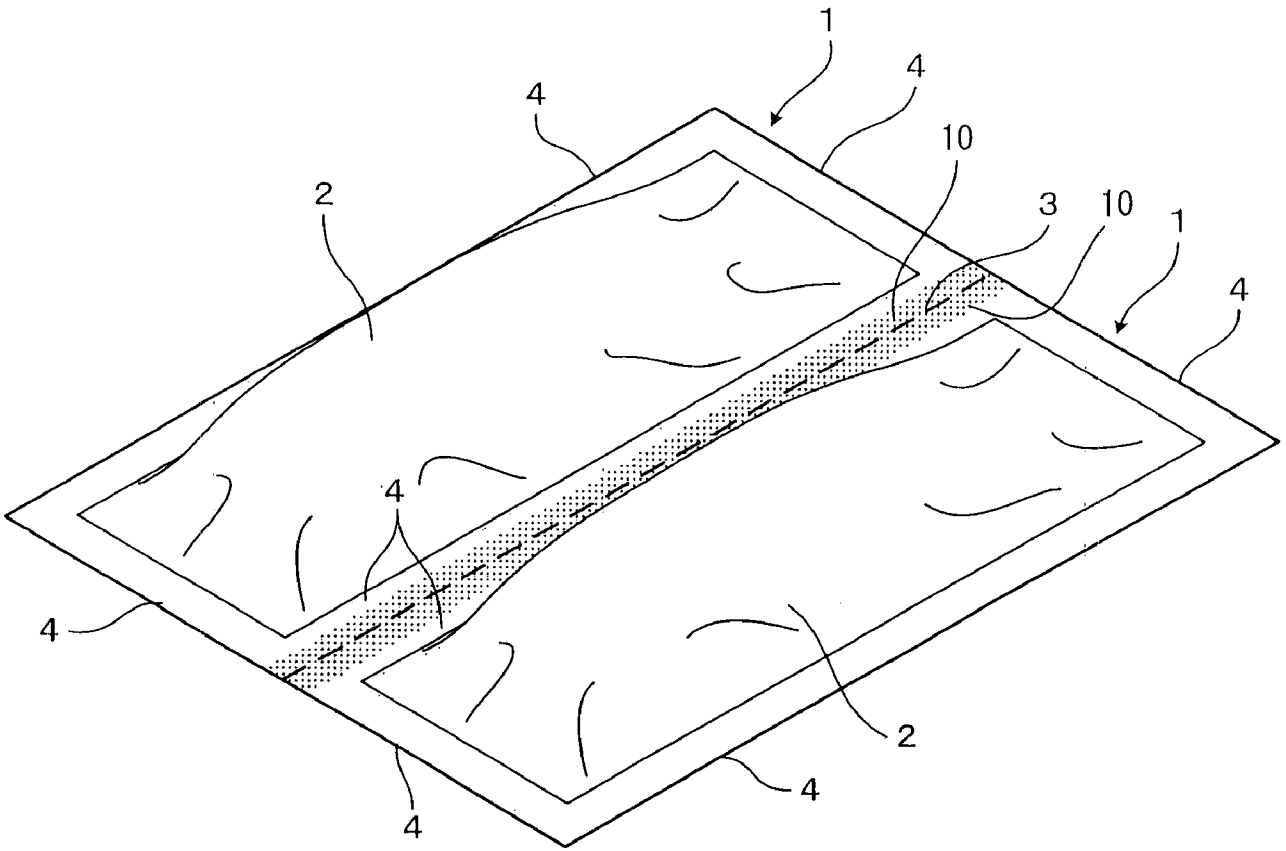
FIG. 12 is a perspective view of a container bag according to a fifth embodiment of the present invention.
Figure 13:
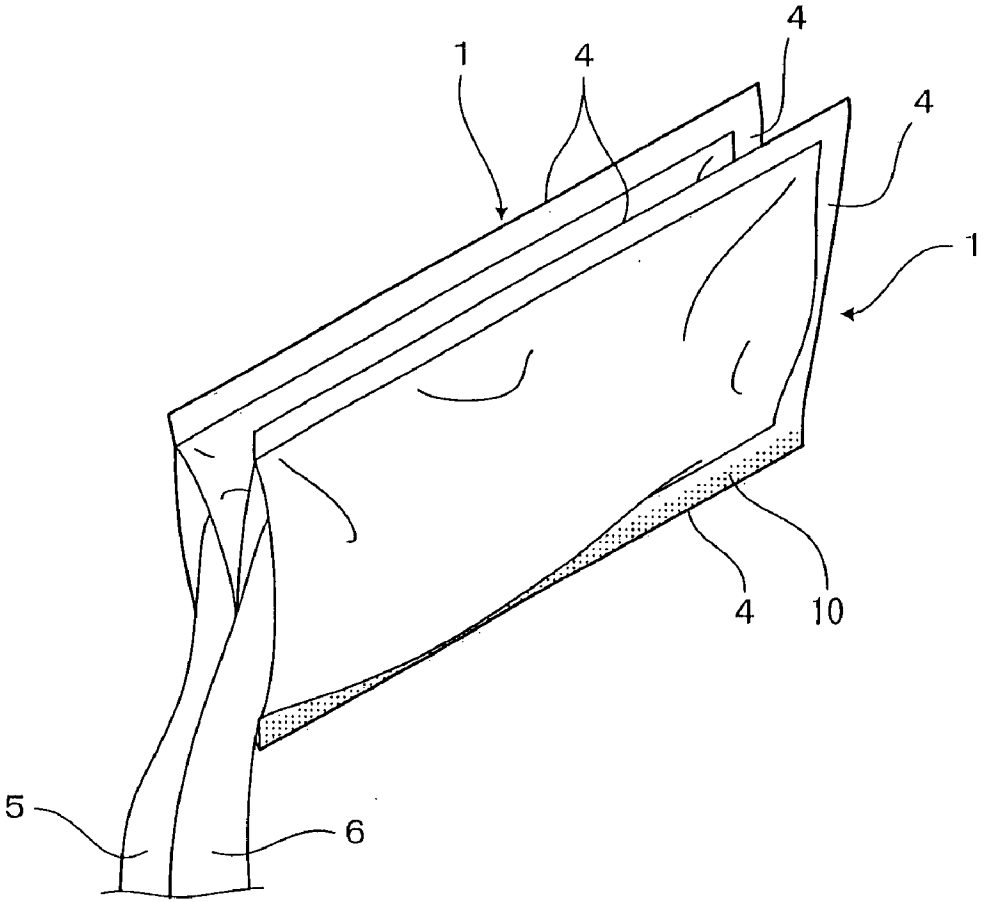
FIG. 13 is a perspective view showing how a contained matter is taken out from the container bag.

FIGS. 12 and 13 show a fifth embodiment.

Description will be given with reference to FIGS. 12 and 13. In the fourth embodiment, the two continuous container bags 1, 1 are folded in two using the perforated line 3 as a fold line. In this state, the two container bags 1, 1 are simultaneously cut using the notch 8. Then, the container bags 1, 1 are squeezed with fingertips to simultaneously take out the mustard 5 and ketchup 6 contained therein. However, in the fifth embodiment, instead of the notch, innumerable fine pores are formed in the two sheets 2, 2 in their heat seal portions 4, extending along the perforated line 3. Accordingly, when the two continuous container bags 1, 1 are folded in two using the perforated line 3 as a fold line, they can be simultaneously cut at any position of the fold line. The other arrangements of this embodiment are the same as those of the first embodiment. Their detailed description is thus omitted. In the drawing, the innumerable fine pores 10 are formed along the substantially entire length of the perforated line 3. However, these fine pores may be formed along part of the perforated line so as to lie close to an end of the perforated line 3 and the side of the matter containing section of each container bag 1.

Furthermore, although not shown in the drawing, the above configuration can be used with one sheet 2 composed of a synthetic resin film and folded in two to form two continuous container bags 1, 1 the corresponding long sides of which are joined together as described in the third embodiment or the variation of the fourth embodiment. That is, innumerable fine pores can be formed in the two sheets 2 in their heat seal portions 4, extending along the perforated line 3 between the two container bags 1, 1. Then, when the two container bags 1, 1 are folded in two using the perforated line 3 as a fold line, they can be simultaneously cut at any position of the fold line. Of course, even with the container bags shaped as described previously in the first embodiment, innumerable pores can also be formed in the two sheets 2 in their heat seal portions 4, extending along the perforated line 3.

Figure 15:
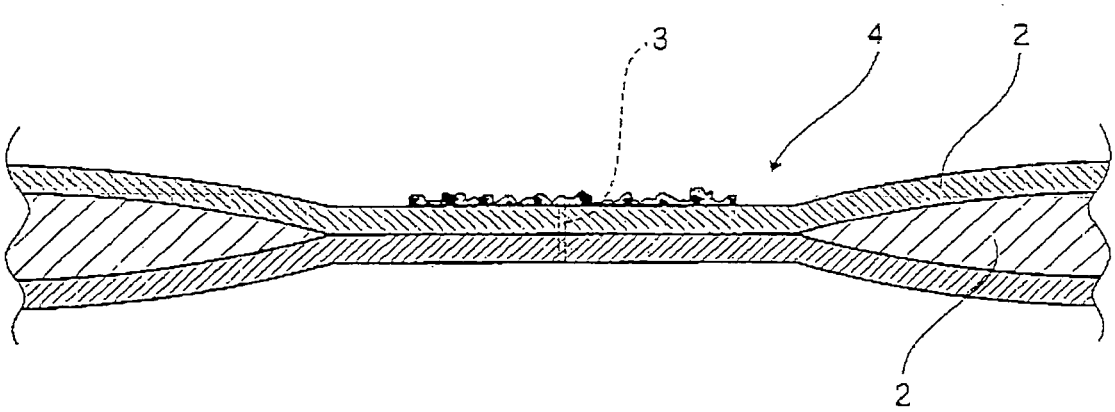
FIG. 15 is a cross-sectional view of the container bag according to an additional embodiment of the present invention

Instead of forming the notch portion 8 or the innumerable fine pores 10 so as to allow the two continuous container bags 1, 1 as folded in two to be cut, a coating layer 11 (FIG. 15) composed of a mixture of ceramic, metal, and other powders may be formed on at least either the outer front or back surface of the bags at the position of the perforated line 3. When coating layer 11 composed of a mixture of ceramic, metal, and other powders is thus formed on at least either the outer front or back surface of the bags, if the container bags are torn off at the portion provided with coating layer 11, then the sheets forming the outer surfaces of the container bags are damaged by the ceramic, metal, and other powders. Then, the container bags are easily torn off and can thus be cut easily. The extent of coating layer 11 may correspond to part of or the substantially entire length of the perforated line 3 as in the previously described embodiments.

Furthermore, the two continuous container bags 1, 1 in the embodiments shown in the above-described drawings are of the same size. However, one of the container bags may be larger than the other.

In the above-described embodiments, the mustard 5 is contained in one of the two container bags 1, 1, while the ketchup 6 is contained in the other. When the mustard 5 and the ketchup 6 are used as seasoning sauce for a hot dog sold at a store, they are taken out from the container bags 1, 1 for use. However, the container bags may contain seasoning sauce such as Chinese spicy oil and seasoning sauces for Chinese dumpling which are mixed together for use, or liquids of a two-liquid mixture adhesive. That is, the container bags may preferably contain plural kinds of matters which are used in a mixed state.

Further, in the above-described embodiments, the two continuous container bags 1 are joined together so as to be simultaneously cut. However, three, four, five, or six container bags may be joined together likewise, so that different matters may be contained in the respective container bags, and the plurality of container bags may be folded up at the joint portions. Subsequently, notches, innumerable fine pores, and coating layers composed of a mixture of ceramic, metal, and other powders may be formed in the container bags as described previously. Thus, the plurality of container bags can be simultaneously cut to allow the separate different contained matters to be simultaneously taken out.

Figure 14:
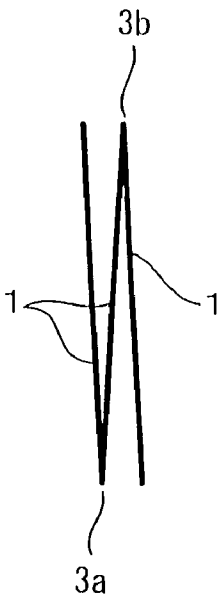
FIGS. 14(A), 14(B) and 14(C) are schematic plan views showing where notches or the like are formed when three or more container bags are joined together.
Figure 14:
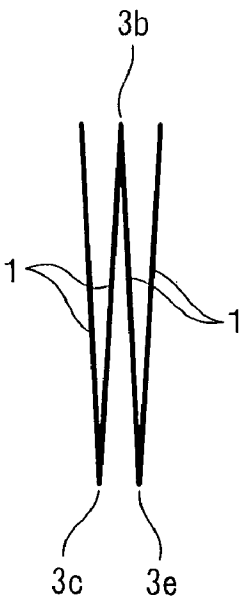
Figure 14:
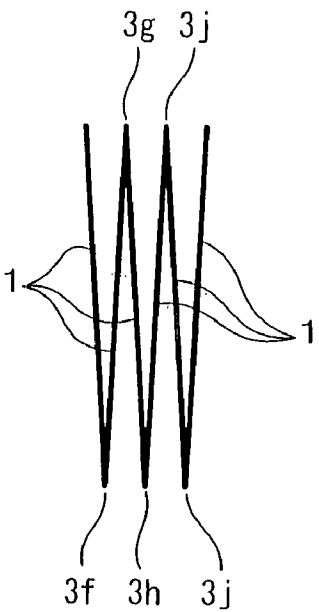

FIG. 14(A) shows that three container bags 1 are joined together and folded up. FIG. 14(B) shows that four container bags 1 are joined together and folded up. FIG. 14(C) shows that six container bags 1 are joined together and folded up.

Description will be given with reference to FIGS. 14(A) to (C). In the three container bags 1 joined together as shown in FIG. 14(A), two perforated lines 3*a* and 3*b* constitute fold lines when the container bags 1 are folded up, and a notch, innumerable fine pores, or a coating layer composed of a mixture of ceramic, metal, and other powders may be formed at least at the position of the perforated line 3*a*, which joins the two container bags 1, 1 together. A notch, innumerable fine pores, or a coating layer composed of a mixture of ceramic, metal, and other powders may or may not be formed at the position of the perforated line 3*b*, to which the remaining one container bags 1 is joined. Then, if a notch, innumerable fine pores, or a coating layer composed of a mixture of ceramic, metal, and other powders is formed at the position of a free end of the remaining one container bag 1 at which the heat seal portion 4 is present which is opposite to the heat seal portion 4 extending along the perforated line 3*b*, then the three container bags 1 as folded up can be simultaneously cut to form contained-matter take-out openings. Further, in the four container bags 1 joined together as shown in FIG. 14(B), three perforated lines 3*c*, 3*d*, and 3*e* constitute fold lines when the container bags 1 are folded up, and notches, innumerable fine pores, or coating layers composed of a mixture of ceramic, metal, and other powders may be formed at least at the positions of the perforated lines except the central one 3*d*, i.e. the perforated lines 3*c* and 3*e*, located on the opposite sides. A notch, innumerable fine pores, or a coating layer composed of a mixture of ceramic, metal, and other powders may or may not be formed at the position of the perforated line 3*d*. Thus, the four container bags 1 as folded up can be simultaneously cut to form contained-matter take-out openings. Furthermore, also in the six container bags 1 joined together as shown in FIG. 14(C) and having perforated lines 3*f* to 3*j*, notches, innumerable fine pores, or coating layers composed of a mixture of ceramic, metal, and other powders may be formed at least at the positions of the perforated lines 3*f*, 3*h*, and 3*j* located on the opposite sides and at the center. A notch, innumerable fine pores, or a coating layer composed of a mixture of ceramic, metal, and other powders may or may not be formed at the positions of the remaining perforated lines 3*g* and 3*i*. Thus, the six container bags 1 as folded up can be simultaneously cut to form contained-matter take-out openings.

In the above-described embodiments, the perforated line 3 is formed between the adjacent container bags so that the two or three or more container bags can be folded up using the perforated line 3 as a fold line. Thus, the matters contained in the respective container bags can be simultaneously taken out. The perforated line need not necessarily be formed between the adjacent container bags so as to allow the matters contained in the respective container bags to be simultaneously taken out. Instead, a fold line may be formed.

When a perforated line is formed between the adjacent container bags as described above, if seasoning sauce are contained in these container bags and one of the seasoning sauce is to be taken out according to the user's taste, the container bag containing this seasoning can be cut off from the other container bag to take out the user's favorite seasoning.

Further, the sheet constituting the container bag may be composed of a plurality of synthetic resin films stacked together. However, the sheet may be made by depositing aluminum on a film matter of a synthetic resin. The composition of the sheet is not specifically limited. Furthermore, the form of the container bag is not limited to those shown in the above-described embodiments.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

What is claimed is:

1. Container bags for containing seasoning sauces or other matters to be contained separately and then taken out and mixed together for use, comprising:

two container bags for individually containing two kinds of matter, said container bags made of sheets comprising synthetic resin films and joined together to be continuous;

a fold line for folding up said two container bags, said fold line formed in a joint portion between said two container bags; and at least one notch for forming a contained-matter take-out opening formed at a position on the fold line in the joint portion; and said two container bags have an outer, parallelogram shape and two opposing ends, said two container bags being joined together so that said outer shape of the joined container bags have one end of said two opposing ends project in V form while the other end of said two opposing ends is split in V form.

2. The container bags according to claim 1 wherein said notch is formed at a position close to an end of each fold line and at a lateral side of a matter-containing section of each container bag.

3. The container bags according to claim 1, wherein said at least one notch is formed equidistantly at a plurality of positions in a longitudinal direction of the fold line.

4. The container bags according to claim 1, wherein the fold line is a perforated line.

5. Container bags for containing seasoning sauces or other matters to be contained separately and then taken out and mixed together for use, comprising:

two container bags for individually containing two kinds of matters, said two container bags made of sheets comprising synthetic resin films and joined together;

a fold line for folding up the two container bags formed in a joint portion between the two bags; and a plurality of fine pores for forming a contained-matter take-out opening formed along and around the fold line in the joint portion; and wherein said two container bags have an outer, parallelogram shape and two opposing ends, said two container bags being joined together so that said outer shape of the joined container bags have one end of said two opposing ends project in a V form while the other end of said two opposing ends is split in a V form.

6. The container bags according to claim 5, wherein said plurality of fine pores are formed to lie close to an end of each fold line and at a lateral side of a matter-containing section of each container bag.

7. The container bags according to claim 5, wherein said plurality of fine pores are formed over a substantially entire length of each fold line.

8. The container bags according to claim 5, wherein the fold line is a perforated line.

* * * * *